United States Patent [19]

Ortega De La Orden

[11] Patent Number: 4,744,525

[45] Date of Patent: May 17, 1988

[54] DEVICE FOR REGULATING THE RETENTION TIME OF THE MATERIAL IN A GRINDING MILL

[75] Inventor: Vincent Ortega De La Orden, Brussels, Belgium

[73] Assignee: Slegten Societe Anonyme, Belgium

[21] Appl. No.: 921,043

[22] PCT Filed: Jan. 27, 1986

[86] PCT No.: PCT/BE86/00003

§ 371 Date: Oct. 6, 1986

§ 102(e) Date: Oct. 6, 1986

[87] PCT Pub. No.: WO86/04526

PCT Pub. Date: Aug. 14, 1986

[30] Foreign Application Priority Data

Feb. 8, 1985 [LU] Luxembourg ..... 85767

[51] Int. Cl.[4] ..... B02C 17/00

[52] U.S. Cl. ..... 241/171; 241/284

[58] Field of Search ..... 241/171, 284

[56] References Cited

U.S. PATENT DOCUMENTS 2,482,740 9/1949 Brown, Jr. ..... 241/171

3,180,581 4/1965 Velcheff ..... 241/171 X

*Primary Examiner*—Howard N. Goldberg

*Assistant Examiner*—Joseph M. Gorski

*Attorney, Agent, or Firm*—Fishman, Dionne & Cantor

[57] ABSTRACT

A device which regulates the retention time of material ground in a grinding mill is disclosed. The device comprises a cylindrical casing, a wall in the casing having a plurality of apertures therethrough, a reservoir chamber defined between the wall and a side of the casing, lifting structure in the reservoir chamber, and a discharge scoop spaced from the casing and extending into the reservoir chamber. The discharge scoop comprises a hollow longitudinal member including a first opening on its upper surface and a second opening on its lower surface, with the openings being spaced longitudinally from each other.

11 Claims, 3 Drawing Sheets

III
III
V
V
13
12
14
16
19
18
75
33
30
25
26
28
29
31
32

32
16
26
30
78

IV
IV
1
30
34
33
19
25
26
9
12
27
11
78
75
7
5
31
32
3
18
13

DEVICE FOR REGULATING THE RETENTION TIME OF THE MATERIAL IN A GRINDING MILL

The device of the invention is in preference intended for regulating the retention time of the material, for the grinding of mineral ores with single chamber, autogenous, semi-autogenous of ball grinding mills in wet grinding mode.

In these mills the discharge of the material from the grinding chamber is effected either by overflowing or through an outlet grate.

Grinding mills with overflow discharge generally retain the material for too long a period in the grinding chamber, which has the effect of producing undesirably fine particles; the grinding mill is overfilled on account of the excessive retention time, with the result that the load tends to slip and the mill's output is reduced.

Grinding mills equipped with a grate discharge the material more rapidly, are not subject to overfilling, and have a higher output. However, the retention time in these mills is often too short, they contain too little material and the mill does not function at its optimum efficiency. In ball mills—in which it is an advantage to use cast balls in treated alloys for greater hardness and better resistance to wear—, the hard balls tend to scale, with the result that their resistance to wear is seriously affected.

Various outlet grate devices have been designed, to optimize the retention time of the material in the grinding mills.

Said devices generally consist of a frame, the upstream face of which is open and covered by grids provided with a number of apertures which allow ground material to pass, but retain insufficiently ground material, and the grinding media if any; the upstream face of the device is spaced apart from the downstream face, which is solid except for a central discharge opening; the space between the two said faces forms a small discharge chamber to receive the material which has passed the grids. Lifting elements fixed within the discharge chamber raise, by the rotation of the mill, the material above the centre line of the mill, and let it fall on to a deflector which directs it towards the central discharge outlet.

In an attempt to control the retention time of the material, efforts have been made to regulate the passage of the material through the apertures in the grids, for example by progressively blocking these apertures as in patents DE-420 049 and U.S. Pat. No. 1,787,897. All of these blocking mechanisms are nevertheless rapidly jammed by particles and all kinds of waste passing through the grids, with the result that regulation becomes inoperative.

Patents DE-477 135 proposed a deflector in the form of a mobile cone integral with the mill; this would partially or totally return the material coming from the lifting elements (paddles in this case) back into the compartment upstream of the discharge compartment, in order to re-grind coarse particles which had entered the discharge compartment. With this system, the recirculated material passes again into the grid, which should theoretically give some control over the retention time in the mill. However, as the cone is integral with the mill, a major part of the regulating mechanism functions within the mill itself; this device is therefore very vulnerable on account of wear and jamming caused by the presence of ore particles and steel scrap.

Patent GB-812 320 describes a system by means of which the lifting paddles can be progressively neutralized using adjustable-angle chutes. These adjustable chutes and a major part of the control mechanism are also integral with the mill and have to function in the material. The invention described in patent GB-812 320 is intended for the dry grinding of selflubricating carbonaceous material. Such a system could not function on a long-term basis in a wet process and/or with materials such as mineral ores which would cause it serious abrasion and jamming.

Patent CA-884 866 describes a mill discharge launder, which can be disposed in an operative position within the mill discharge trunnion, to receive material from the lifting members of the mill discharge chamber, and to deliver said material from the mill. Said launder can be movable between said operative position and an inoperative position, wherein it is withdrawn from the said trunnion. The aim of the launder is designed to give easy access to the mill to facilitate the maintenance. It can be provided with locking means with adjustable abutment means defining the operative position of the launder and which allows small variations in the operative position. However, during mill operation, the launder has to lie in closely spaced relationship to the upstream wall of the mill discharge compartment. The device of patent CA No. 884866 is not forecasted to be used in other alternative positions than the operative or inoperative aforesaid two positions—the embodiments shown on the figures of patent CA No. 884866 would hit against the mill if they were noticeably moved from their operative position without retracting at least one of their wings—, nor to regulate the retention time of the material in the mill.

In U.S. Pat. No. 3,078,050, the embodiment of FIGS. 10 and 11 has neither grate nor discharge chamber, but the material is taken out of the grinding mill by a chute entering into the grinding compartment, said chute having appropriate positioning means to remove material from the mill in a controllable manner. As it is the maintenance of a chute working in a grinding compartment of an autogenous mill is problematical, it would be unpractical in a semiautogenous or a ball mill, now a number of autogenous mills have to be converted to a semi-autogenous mode for changes in the feed characteristics.

Patents GB-2 064 364 and FR-2 261 812 describes an arrangement wherein the discharge screening wall has at least one first group of relatively small grate openings and one second group of relatively large openings, said second group of openings communicating with an individual material outlet via switching means, by which the material mixture passing through said second group of openings can be prevented from leaving the mill. With this arrangement, the switching means act only on part of the material—the part coming from the relatively large openings—and not on the material coming from the relatively small openings, this is not sufficient to control properly the retention time of the material in the mill. Besides it appears that, to make the system operative, the clearance between the switching means and the cooperative element has to be small, that is not larger than the coarser particles entering the relatively large openings, therefore the described arrangement is not safe from jamming with said coarser particles.

U.S. Pat. No. 3,801,025 describes a device which, in its preferred form, enables the effective volume of the lifters to be regulated by turning them around their axis.

This adjustment can be carried out from outside the mill and during its operation. Although the mechanism of this type is less subject to jamming than those described above, its reliability is nonetheless uncertain; the lifters get blocked from time to time, and there are material leakage problems where the lifters pass through the mill shell. In many mills it is difficult to install this device at the outlet, for the grinding mill is subjected to high stress at the point of connection between the casing and the end bottom and it is not always acceptable that holes should be bored at this point to take the lifters axles. In addition, a toothed crown driving the mill is often fixed at the outlet, and its casing makes the installation of levers, rollers and guide rail difficult.

In U.S. Pat. No. 4,171,102, the lifters are regulated by modifying the position in which they are bolted; there is no mechanism which might be liable to breakdowns. This device is widely used, particularly in the cement industry, and it has made possible a distinct improvement in mill output. It has nevertheless two disadvantages; adjustements have to be made from within the tube, and the mill has to be stopped for this purpose. The regulation cannot be adjusted as often as the changing working conditions of any mill demand.

The present invention aims to avoid the disadvantages inherent in the devices of the state of the art; by enabling the retention time of the material in a mill to be regulated in a simple, practical and particularly a very reliable manner, so that the mill can work in optimum conditions in terms of efficiency, output, and wear on the grinding media with easy maintenance.

The device of the invention enables controls to be carried out from outside the mill and whilst it is in operation.

An additional object of the present invention is to provide a device of the above-mentioned type which is suitable for most grinding mills and which may be adapted to them without costly prior transformations.

The aims of the present invention are achieved by a device for regulating the retention time of the material in a mill, in particular an autogenous, semi-autogenous or ball grinding mill which includes a cylindrical tube casing equipped with an inlet bottom and an outlet bottom, the said device including a reservoir chamber delimited by an upstream face provided with a number of apertures which allow sufficiently ground material to pass and retain insufficiently ground material and the grinding media if any, and by a downstream face, solid exept for a discharge aperture, the aforementioned reservoir chamber being provided with lifting means, to entrain upwards the material entered in the reservoir chamber when the said lifting means pass under the grinding mill centre line, due to the mill rotation, and to discharge the entrained material through the central part of the reservoir chamber when lifting means pass above the mill centre line; characterized by the fact that the device includes a discharge scoop, which enters the reservoir chamber through the outlet bottom, which is approximately coaxial with the grinding mill, which is separate from the said mill, the clearance between the discharge scoop and the rotating part of the grinding mill being at every point greater than the largest particles which can enter the reservoir chamber, and which can be moved longitudinally to operate from a position close to the upstream face of the reservoir chamber to a variety of positions where the discharge scoop is partially or totally withdrawn from the said reservoir chamber, whereby the discharge scoop adjustable positioning cooperate with the lifting means to recirculate within the reservoir chamber a controllable part of the material discharged from the lifting means.

The control, of the proportion of material discharged from the lifting means which is recirculated within the reservoir chamber, enables the adjustment of the quantity of material contained in the reservoir chamber, in fact the raising capacity of the lifting means depends on the level of the material in the reservoir chamber, to any material raising output corresponds a specific level of the material in the reservoir chamber : the more the material is recirculated within the reservoir chamber, the higher has to be the raising capacity of the lifting means and the higher is the equilibrium level of the material in the reservoir chamber, and vice versa the less the material is recirculated, the lower has to be the raising capacity of the lifting means and the lower is the equilibrium level of the material in the reservoir chamber. The level of material into the upstream grinding chamber equilibrates to the minimum at the level existing in the reservoir chamber, now the retention time of the material in a grinding mill depends on the level of the material in the grinding chamber, therefore it can be controlled by the adjustable positioning of the discharge scoop of the device of the invention.

As the passage through the outlet bottom is generally cylindrical, it is an advantage to make the discharge scoop cylindrical to give it maximum strength, and to provide it, in the upper parts of its upstream extremity, with a first opening of approximately the same length as the reservoir chamber, and at a distance from this first opening, essentially outside the reservoir chamber, with a second opening facing downwards.

Preferably, the discharge scoop is plugged at its upstream extremity and also downstream of the aforementioned second opening facing downwards.

The longitudinal movement of the discharge scoop can be controlled by a motorized device, such as an hydraulic, pneumatic or screw jack, which acts, possibly through a counterlever, on an extension piece to the discharge scoop.

Other details and advantages will be made apparent on reading the following description of preferred forms in which the device of the invention may be applied and which are given as examples; together with a study of the attached drawings in which.

Identical references in these drawings refer to identical or analogous elements.

Figure 1:
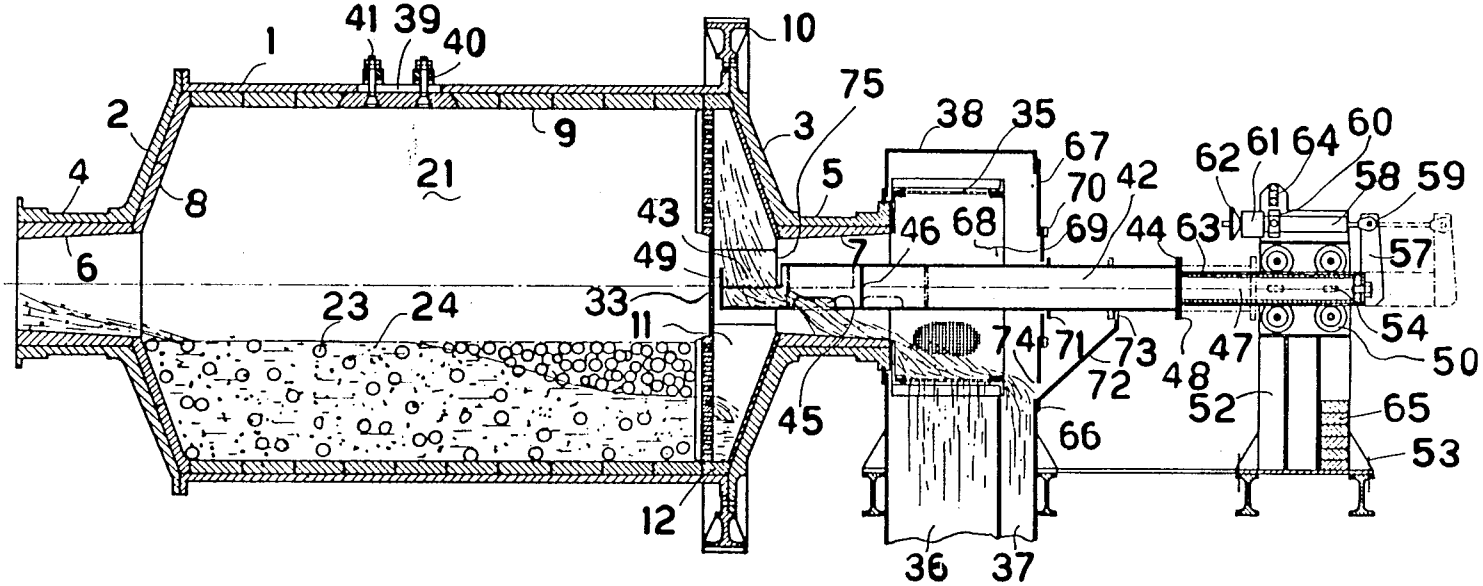
FIG. 1 shows a longitudinal section on line I.I. of FIG. 2, of a grinding mill equipped in accordance with the invention.

The mill shown in FIG. 1 functions in wet grinding mode and consists of a tube casing 1, bearing on two conical bottoms 2 and 3, a trunnion 4 is integral with bottom 2 on the inlet side and a trunnion 5 is integral with bottom 3 on the outlet side. The trunnions are carried on bearings which are not shown in FIG. 1. The grinding mill is driven by a crown toothed wheel 10 and a pinion which is not shown. The crown toothed wheel and pinion are protected by a cowling which is not shown. The trunnions are hollow.

A trommel screen 35 is fixed to trunnion 5. Beneath the trommel 35 are two chutes 36 and 37. The end of trunnion 5, the trommel 35 and the chutes 36 and 37 are enclosed in a box 38.

To protect the mill from wear, the trunnions 4 and 5 are provided with sleeves 6 and 7, the inlet bottom 2 with a lining 8 and the tube casing 1 with a lining 9. The tube casing 1 is provided with a manhole 39, the cover of which is formed by an element of the lining 9 fixed by stirrups 40 and bolts 41. The elements constituting the linings 8 and 9 are small enough to pass through the aforesaid manhole and are fixed to the grinding mill by bolts which are not shown.

A reservoir chamber 11 is mounted to butt against the bottom 3, at the outlet end from the grinding chamber 21. The grinding chamber 21 is partially filled with grinding media 23—cast steel balls in the example shown—and with the material for grinding 24.

Figure 4:
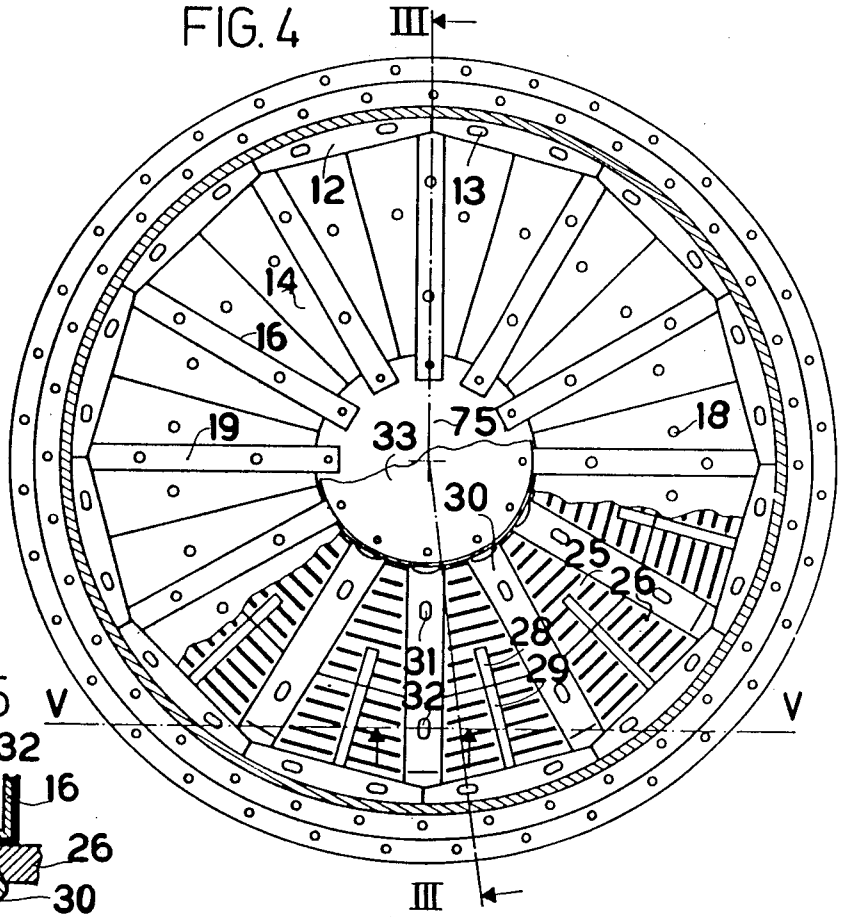
FIG. 4 is a section on line IV—IV of FIG. 3.

The foot of the reservoir chamber 11 is constituted by cast segments 12 which fit the end bottom 3, the upstream face of which butts against the lining 9, the internal face of the segments 12 forms a 12-sided surface (see FIG. 4). The segments 12 are bolted to the bottom 3 by bolts 13.

Figure 3:
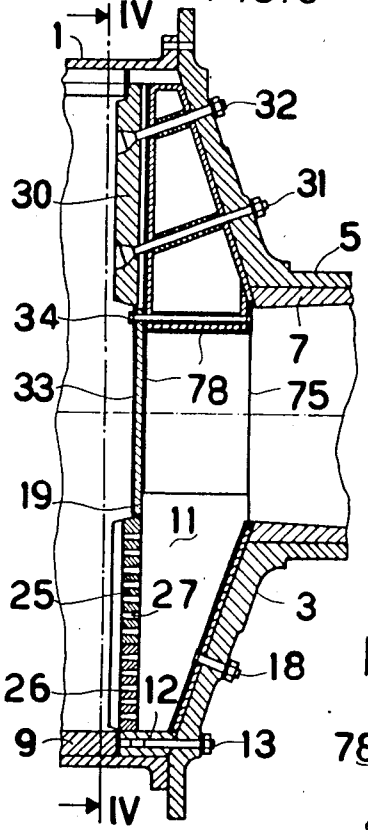
FIG. 3 is a partial and enlarged view of the mill and the device as shown in FIGS. 1 and 2 on line III—III of FIG. 4.

FIG. 3 shows the reservoir chamber 11, the outlet bottom and the entry of the outlet trunnion, the discharge scoop 42 being omitted. The reservoir chamber 11 includes a frame constituted by 12 segments 14 (see FIG. 4). The downstream face of each of the segments 14 forms a truncated section, in such a way that the whole of the segments bear on the bottom 3 and cover the entire bottom between the cast segments 12 and the internal face of the sleeve 7 of the outlet trunnion 5. The edge of the segments 14 demarcates the discharge aperture 75 of the reservoir chamber 11.

A closed sheet metal caisson 16 is welded on to each segment 14 and constitutes a lifting means; this caisson is radial, it commences from the periphery of the segment 14 and ends slightly beyond the central edge of the caisson 14 for the described application. All parts in contact with the material of the segments 14 and the caissons 16 are rubber-covered 78, to protect them from wear. The segments 14 are bolted to the bottom 3 by bolts 18. The upstream faces 19 of the caissons 16 are in the same plane, at right angles to the axis of the grinding mill, and form the upstream face of the reservoir chamber 11 frame.

Cast steel grids 25 and 26 butt against the upstream face 19 of the caissons 16. The grids are pierced by a number of apertures 27, through which ground material can pass, but which prevent the passage of insufficiently ground material and grinding media. The apertures 27 are in elongated form and are orientated tangentially. The apertures 27 taper outwards from their inlet side at the upstream face of the grids to their outlet side at the downstream face of the grids, so that the particles which enter them can easily pass through.

On the grinding chamber side the grids 25 and 26 are provided with ribs 28 and 29. The grids 25 and 26 are small enough to pass through the manhole 39.

Figure 5:
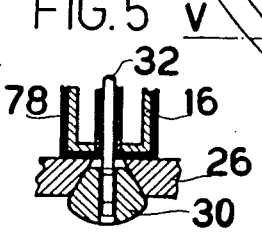
FIG. 5 is a partial section on line V—V of FIG. 4.

The grids 25 and 26 are wedged one against the other, in pairs—i.e. a central grid 25 with a peripheral grid 26—against the segments 12 and the caissons 16, by cast steel wedge-shaped elements 30, fixed by bolts 31 and 32, which pass through the caissons 16 and the bottom 3. The elements 30 are proud of the upstream face of the grids (FIG. 5).

The projecting part of the elements 30 and the ribs 28 and 29 gather the grinding media during the rotation of the grinding mill, and thus reduce slip friction between the load and the grids in order to lessen wear on the latter.

The centre of the upstream face of the chamber 11 is closed by a sheet metal disc 33, rubber-covered 78 on both sides. It is fixed to the caissons 16 by bolts 34.

The segments 14, the cast segments 12 and the grids 25 and 26 demarcate the reservoir chamber 11, which is divided into twelve compartments by the caissons 16.

Figure 2:
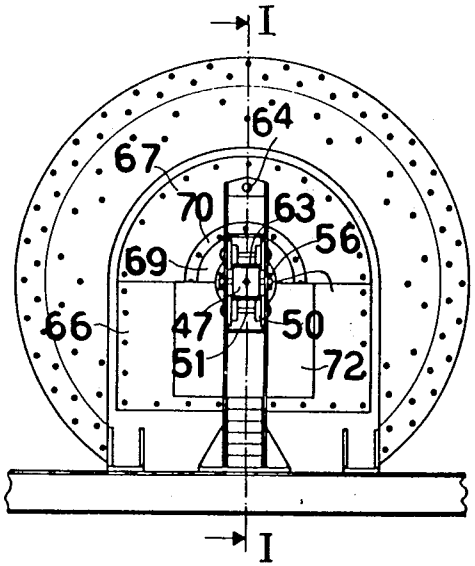
FIG. 2 shows the mill and the device of FIG. 1, viewed from downstream of the installation.

As shown in FIGS. 1 and 2, a cylindrical steel discharge scoop 42, which is coaxial with the grinding mill, enters the reservoir chamber 11 through the discharge aperture 75. On the downstream side, the cylinder 42 passes through the trunnion 5, the trommel 35, the box 38 and is terminated by a flange 44. The external diameter of the discharge scoop 42 is such that the clearance between the discharge scoop and the rotating parts of the grinding mill which are closest to the discharge scoop 42 is greater than the largest particles which can enter the reservoir chamber. The discharge scoop 42 is closed on its upstream side by a disc 49; downstream of the disc a first semi-circular opening 43 is provided, which faces upwards and has the same length as the reservoir chamber 11. Slightly downstream of the semicircular opening 43 is a second opening 45 facing downwards, which connects the discharge scoop 42 with the trunion 5. Downstream from the opening 45, the discharge scoop is closed by a disc 46. The discharge scoop may be rubber-covered at wear points.

A square-section steel tube 47, fixed to the discharge scoop 42 by a bolted counter-flange 48, forms an extension of the discharge scoop 42. The axis of the square-section tube 47 coincides with the axis of the discharge scoop 42. The square-section tube 47 is carried and guided by four rollers 50 which, by means of axles 51 are held on a welded support structure 52 fixed to the flooring by four bolts 53. The square-section tube 47 is guided laterally by four rollers 54 fixed to ears 56 which are integral with the support structure 52. Hardened steel wear plates 63, bolted to the square-section tube 47 are placed between the square-section tube and the rollers 50.

A counterlever 57 bolted on the end of the square-section tube 47, links the latter to a screw jack 58, through the intermediary of a ball joint 59. The jack is fixed to the support member 52 by a universal joint 60. The jack is controlled by a back-geared motor set 61. A handwheel 62 enables the jack to be operated manually in the event of a power cut. The elements referred to by numbers 10, 57, 58, 59, 60, 61 and 62 have been omitted from FIG. 2 for reasons of clarity.

The travel of the jack moves the square-section tube 47 and the discharge scoop 42 in such a way that the disc 49 may, at its extreme positions, be either only a few centimetres from the disc 33 (position shown by solid lines in FIG. 1) or be completely withdrawn from the reservoir chamber 11 by retracting within the trunnion (position shown by dotted lines). The opening 45 remains in the trunnion and/or the trommel screen 35, whatever the position of the discharge scoop 42.

An eyelet 64 is situated close to the end of the support member 52 nearest to the grinding mill, for the purpose of raising the support member with the discharge scoop 42 and the control mechanism. A counterweight 65 is provided to balance the discharge scoop.

The downstream face of the box 38 is closed by two demountable panels 66 and 67, which are joined on an horizontal line on the axis of the grinding mill. The panels 66 and 67 provide access to the inside of the box, particularly for maintenance of the trommel screen. A hole 68, greater than the discharge scoop 42, allows the latter to pass and enables the ensemble formed by the discharge scoop 42 and the support member 52 to be dismantled.

A rubber plate 69, fixed by a flat 70, partially obstructs the hole 68 in such a way that during operation a small clearance is maintained between the inner edge of the plate 69 and the discharge scoop 42.

A flange 71 is fixed on to the discharge scoop 42, in such a way that it is close to the ring 69, but outside the box 38, when the discharge scoop is in the position where it is closest to the disc 33.

A small hopper 72, the upper part of which is open and a the level of the grinding mill axis, is fixed on to the panel 66, on the outside of the box 38. The downstream side of the hopper 72 is provided with an aperture 73 to give passage to the discharge scoop 42. The length of the hopper 72 is such that the flange 71 remains in the hopper when the discharge scoop 42 is in the working position where it is furthest from the disc 33. A hole 74 in the panel 66 gives communication between the bottom of the hopper 72 and the interior of the box 38.

The material for grinding, a mixture 24 of mineral ore and water, enters the grinding mill by the trunnion 4. The rotation of the mill causes the grinding media 23 to circulate, through the intermediary of the lining 9, and mixes the material with the media 23, which grind the material and ensure that it passes through the grinding chamber 21.

Particles which have been sufficiently reduced in size pass through the apertures 27 in the grids 25 and 26 and enter the reservoir chamber 11. The caissons 16 serve as the means of lifting, and raise the material, by the mill's rotation, above the axis of the mill, from which point it is discharged downwards.

When the opening 43 is in the position where it is nearest to the disc 33, a large proportion of the material discharged from the caissons 16 falls into the opening 43; only a small proportion of the material lifted by the caissons 16 falls beside the discharge scoop and is recirculated in the reservoir chamber.

The material which is collected by the opening 43 flows into the discharge scoop 42, through the opening 45 it falls into the trunnion 5 which is tapered towards the outlet and thus carries it into the trommel screen 35. The fine material which passes the trommel screen 35 is collected by the chute 36, and the coarse particles which have not passed the screen exit at the end of the trommel and are collected by the chute 37.

The liquid which passes along the length of the discharge scoop 42, from the inside of the box 38 to the exterior of the box, by the small clearance existing between the plate 69 and the scoop 42, is halted by the flange 71 and falls into the hopper 72, from which point it is brought back into the box 38 through the opening 74.

The proportion of material discharged by the caissons 16 which falls into the opening 43 is reduced by moving the opening 43 further away from the disc 33; the proportion of material raised by the caissons 16 which falls beside the discharge scoop and is recirculated in the reservoir chamber 11 is thus increased.

For a given mill throughput, the more the quantity of material recirculated in the reservoir chamber increases, the more material the caissons 16 must lift, and the more material the reservoir chamber will contain.

Consequently, for a given mill throughput, and in balanced working conditions, when the opening 43 is moved further away from the disc 33 the recirculation in the reservoir chamber and the level of the material in that chamber are increased. Conversely, when the opening 43 is moved closer to the disc 33, the level in the reservoir chamber 43 is moved closer to the disc 33, the level in the reservoir chamber 11 is decreased.

The level of material in the milling chamber 21 may not be less than the level in the reservoir chamber 11; when the level in the reservoir chamber is increased the level in the milling chamber increases likewise, and conversely when the level decreases in the reservoir chamber it decreases in the milling chamber. By positioning the discharge scoop 42, therefore, it is possible to control the level of the material in the milling chamber and its retention time in this milling chamber, which depends on the said level.

The device described in the invention can be adapted to suit the outlet of most grinding mills, without any special drilling in the tube casing or the end bottom of the grinding mill, and whatever the position of the crown toothed wheel.

As the clearance between the discharge scoop 42—the only part of the device which is in contact with the material and which is moving in relation to the grinding mill—and the rotating parts of the mill is larger than the coarsest particles which can enter the partition, there is very little risk of jamming.

The aperture through the rubber plate 69 where the discharge scoop passes through the downstream face of the box 38—the only joint in the device which comes into contact with the material—functions without friction and requires no maintenance.

As the discharge scoop is separate from the partition and the rotating elements of the grinding mill, the mechanism which controls the positioning of the scoop can be entirely outside the mill, where the environment is better and maintenance is easier. Adjustments made from outside the grinding mill can be carried out whilst the mill is working, and a reliable motorization of the regulation system can be achieved.

By regulating the discharge scoop in a convenient manner, the device described in the invention enables the retention time of the material in the grinding mill to be regulated efficiently, and more precisely, makes it possible to operate it either as an overflow mill, or a grate mill, or in any intermediate position. The quantity of material retained in the mill may be selected to give optimum conditions of efficiency, output and wear on the grinding media. The quantity of material may be suited at all times to the working conditions of the mill. The device described in the invention is both simple and extremely reliable.

The device described in the invention can also be adapted to suit a mill which does not include a trommel screen.

The number of lifting elements can be varied according to working conditions; in certain cases a single lifting element may suffice. The length, orientation, shape and disposition of these elements in the reservoir chamber may also be varied.

Figure 7:
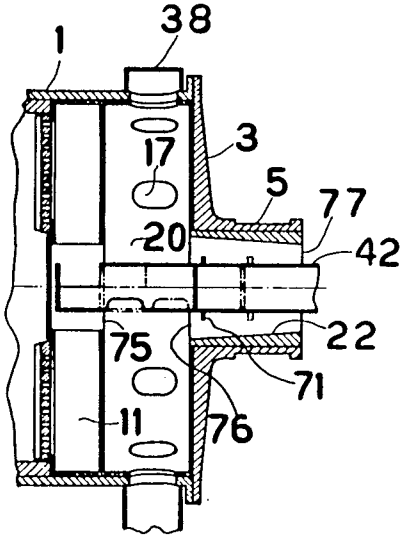
FIG. 7 shows the device described in the invention associated with another type of mill.
Figure 6:
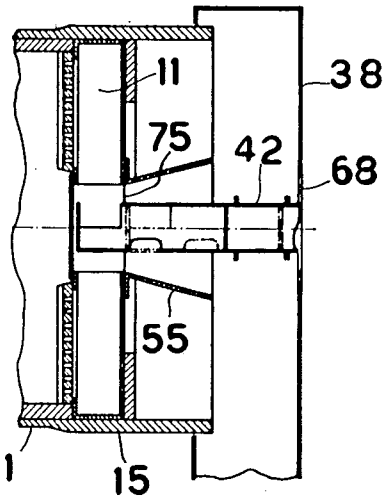
FIG. 6 shows the device described in the invention associated with a particular type of mill.

The downstream face of the reservoir chamber may be in a plane at right angles to the axis of the grinding mill, in particular if the outlet bottom of the mill is vertical (FIGS. 6 and 7). The upstream face of the reservoir chamber may be in the form of a truncated pyramid, the smaller base of which faces the outlet; the sides of this truncated pyramid are then generally demarcated by the grids of a single compartment of the reservoir chamber.

If the mill is carried by rollers or sliding shoes on the outlet side, and discharges into the outlet box through an outlet cone—which replaces the trunnion shown in FIG. 1—the discharge aperture in the downstream face of the reservoir chamber is connected to the cone, and the discharge scoop enters the reservoir chamber 11 through its discharge aperture, passing through the outlet box, outlet cone and mill end bottom.

If the mill is carried on the outlet side by rollers or sliding shoes which support it adjacent to a stiffening collar 15 in its tube casing 1, and if the latter terminates inside the outlet box 38 (FIG. 6), the discharge aperture 75 of the reservoir chamber 11 is provided with a neck 55 and discharges directly into the outlet box, and the discharge scoop enters the reservoir chamber by the discharge aperture, passing through the outlet box, by an opening 68 which may be provided with a rubber plate 69 retained by a flat 70 (see FIG. 1).

If the mill is carried by a trunnion 5 on the outlet side, and if the tube casing 1 passes through the outlet box 38 (FIG. 7), the discharge into the box being through one or more holes 17 pierced through of the tube casing upstream of the outlet bottom 3 of the grinding mill, then the downstream face of the reservoir chamber 11 is spaced apart from the outlet bottom in such a way as to provide a small discharge chamber 20, which includes the peripheral discharge, into which the discharge aperture 75 opens, and the discharge scoop 42 enters the reservoir chamber 11 through the discharge aperture 75, passing through the outlet trunnion 5, the mill end bottom and the small discharge chamber. The discharge scoop 42 may be provided with a flange 71 fixed on the discharge scoop which, during adjustment of the discharge scoop, moves inside the outlet trunnion in which is fixed a cone 22, the large base 76 of the cone 22 communicating with the grinding mill by a hole of the same diameter provided in the outlet bottom, and its small base having a central hole 77 larger than the flange 71 of the scoop, so that the latter can be dismantled.

The arrangement shown in FIG. 7 may be applied to a peripheral discharge mill, carried on the outlet side on rollers or sliding shoes. In this case, a cone 22 is fixed to the end bottom 3 of the mill.

The invention may be associated with an autogenous or semi-autogenous mill, also with a dry grinding mill, and may be used for other materials than mineral ores.

Although the invention has been described in more detail in relation to profitable applications given as examples, it is by no means limited to these examples and its scope is defined by the attached claims.

I claim:

1. A device for regulating the retention time of material ground in a grinding mill, comprising:

a cylindrical casing having first and second opposed sides with said first side including an inlet opening and said second side including an outlet opening, said casing adapted for rotary motion about a longitudinal axis passing through said inlet and outlet openings:

a wall in said casing having a plurality of apertures therethrough, said wall being spaced from said second side and said outlet opening of said casing, a reservoir chamber being defined between said wall and said second side wherein sufficiently ground material passes through said apertures of said wall and insufficiently ground material does not pass through said apertures of said wall, said reservoir chamber including an outlet aperture communicating with said outlet opening of said casing;

lifting means in said reservoir chamber for lifting ground material upwardly when said casing undergoes rotary motion and for discharging the lifted material towards said outlet aperture;

discharge scoop means spaced from said cylindrical casing and extending into said reservoir chamber through said outlet opening and aperture, said scoop means being substantially coaxial with said longitudinal axis of said casing, said scoop means comprising a hollow longitudinal member having an upper surface and a lower surface, said scoop means including a first opening on said upper surface and a second opening on said lower surface, said first and second opening being spaced along said longitudinal axis from each other;

means for adjustably moving said discharge scoop means longitudinally along a plurality of positions between a first position within said reservoir chamber adjacent said wall thereof and a second position withdrawn from said reservoir chamber; and said discharge scoop means cooperating with said lifting means to recirculate within said reservoir chamber a controllable amount of ground material discharged by said lifting means.

2. The device of claim 1 wherein:

said discharge scoop means includes a first closed end upstream of said first opening, and a second closed end downstream of said second opening.

3. The device of claim 1 including:

an extension member coaxially mounted on said discharge scoop means;

wherein said means for adjustably moving said discharge scoop means comprises means acting on said extension member for longitudinally moving said scoop means.

4. The device of claim 3 wherein said means for adjustably moving said scoop means includes a motor and including:

counterlever means connected between said motor and said extension member.

5. The device of claim 3 including:

structural frame means having upper and lower roller means, said extension member being mounted between said upper and lower roller means, wherein said structural frame means supports said discharge scoop means.

6. The device of claim 5 wherein said structural frame means further includes:

lateral roller means for guiding said discharge scoop means.

7. The device of claim 1 wherein said lifting means comprises:

radial caissons.

8. The device of claim 7 wherein said reservoir chamber has an outer periphery and said outlet aperture is defined by an edge and wherein:

said caissons extend radially from said outer periphery of said reservoir chamber to beyond said edge of said outlet aperture.

9. The device of claim 1 including:

a flange downstream of said casing outlet opening, wherein said flange precludes further travel of ground material; and a discharge box for collecting ground material, wherein said flange discharges the ground material into said discharge box for further processing.

10. The device of claim 10 wherein said flange is positioned downstream of said discharge box and including:

said discharge box having a downstream face;

an opening through said downstream face of said box, said discharge scoop means passing through said opening;

plate means fixed to said discharge box opening to effect at least partial closing thereof;

hopper means communicating with said downstream face of said discharge box through said downstream face.

11. The device of claim 10 including:

cone means associated with said flange, said cone means directing ground material precluded by said flange towards said discharge box.

* * * * *